United States Patent [19]

Vatterott

[11] 4,028,877

[45] June 14, 1977

[54] FLUID OPERATED CLOCK

[75] Inventor: Oskar F. Vatterott, Pacific, Mo.

[73] Assignee: Jackson J. Shinkle, St. Louis, Mo.

[22] Filed: May 3, 1976

[21] Appl. No.: 682,713

[52] U.S. Cl. ..... 58/2; 137/624.14; 58/1 R

[51] Int. Cl.[2] ..... G04B 45/00

[58] Field of Search ..... 58/2, 42, 129, 144, 58/1; 137/552.7, 624.14

[56] References Cited

UNITED STATES PATENTS

| | | | |
|---|---|---|---|
| 3,439,695 | 4/1969 | Bauer | 58/42 X |
| 3,620,415 | 11/1971 | Ruth | 58/2 X |
| 3,831,371 | 8/1974 | Vatterott | 58/2 |

*Primary Examiner*—Ulysses Weldon
*Attorney, Agent, or Firm*—Cohn, Powell & Hind

[57] ABSTRACT

This fluid operated clock comprises a support stand which includes a shaft providing a pivot mounting for an oscillating housing, and which carries a reservoir above the housing for supplying fluid to housing inlet openings. The housing is partitioned to provide outer fluid compartments, having fluid discharge openings, and an intermediate compartment mounting an adjustable balance weight above the pivot center. The housing oscillates between defined limits and includes an actuating pin engageable with a pawl and ratchet assembly to rotate a wheel carried by the shaft and having an indicator ring attached.

10 Claims, 7 Drawing Figures

FLUID OPERATED CLOCK

BACKGROUND OF THE INVENTION

This invention relates generally to fluid operated clocks and particularly to a clock having an oscillating pallet assembly and a control balance weight.

The prior art reveals that several attempts have been made to provide satisfactory fluid operated clock mechanism. The simplest of the known mechanisms include a clock having a drive consisting essentially of a water wheel having circumferential, pivotally mounted buckets, the wheel being rotated in one direction by an offset water supply. Another known simple mechanism provides an oscillating pallet arm which is coupled to a conventional clock mechanism by means of a spring-loaded balance, water being supplied alternately to the buckets to cause oscillation. An improved form of this type of structure is to be found in applicant's own U.S. Pat. No. 3,831,371, in which a valve mechanism is used to route the fluid alternately to the buckets. Another variation on the oscillating pallet assembly provides an assembly which is rigidly mounted to a pendulum and utilizes a cam drive wheel which is rotated by the pendulum. The eariler, relatively simple models have the disadvantage of being somewhat inaccurate while the later models suffer from the disadvantage of being more complex and therefore more expensive to manufacture.

The present device solves the above and other problems in a manner not suggested by the known prior art.

SUMMARY OF THE INVENTION

This fluid clock provides a pallet means oscillatively mounted to a support means and providing opposed fluid compartments receiving fluid from a supply source said oscillation being controlled by a balance weight distribution providing a center of gravity disposed above the center of oscillation.

A pair of fixed limit means are provided which are alternately engageable by the pallet means to determine the range of oscillative movement of said pallet means.

Fluid is supplied to one of said fluid compartments when the pallet means engages one of said limit means and the other of said compartments when the pallet means engages the other of said limit means.

The pallet means includes a housing partitioned to define the fluid compartments and to define an intermediate compartment therebetween, a balance weight being movably mounted within said intermediate compartment to selectively determine the oscillation period. The housing is provided with a shock adsorber engageable with the limit means to cushion the impact at each end of the oscillatory travel of the housing.

An indicator ring means is mounted coaxially with the center of oscillation and a drive means, actuated by the pallet means, moves the indicator means in a time indicating relation.

The drive means includes a pawl and ratchet assembly actuated by a member attached to the housing and a worm gear and wheel assembly driven by said ratchet, said worm wheel providing a mounting for the indicator means.

The pawl is rotatable about a pivot axis substantially perpendicular to the pivot axis of the ratchet and is capable of translational movement transversely of its own pivot axis to permit the pawl to move with the ratchet without binding.

The worm gear is mounted to a pivoted level for disengagement of the worm gear and wheel to permit adjustment of the indicator means.

DESCRIPTION OF THE PREFERRED EMBODIMENT

Figure 1:
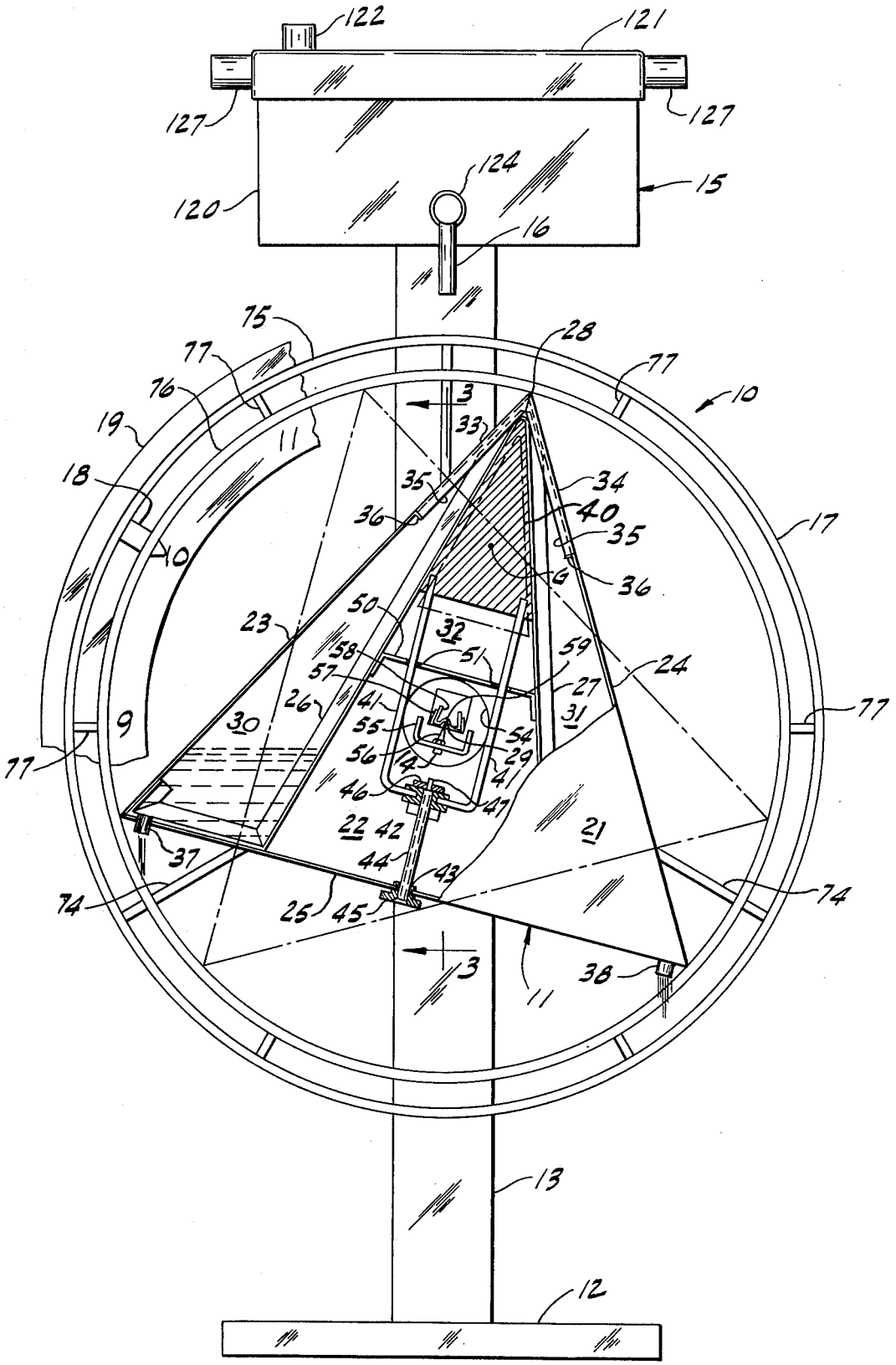
FIG. 1 is an elevational view of the clock with the housing partly broken away to reveal the interior construction thereof.
Figure 2:
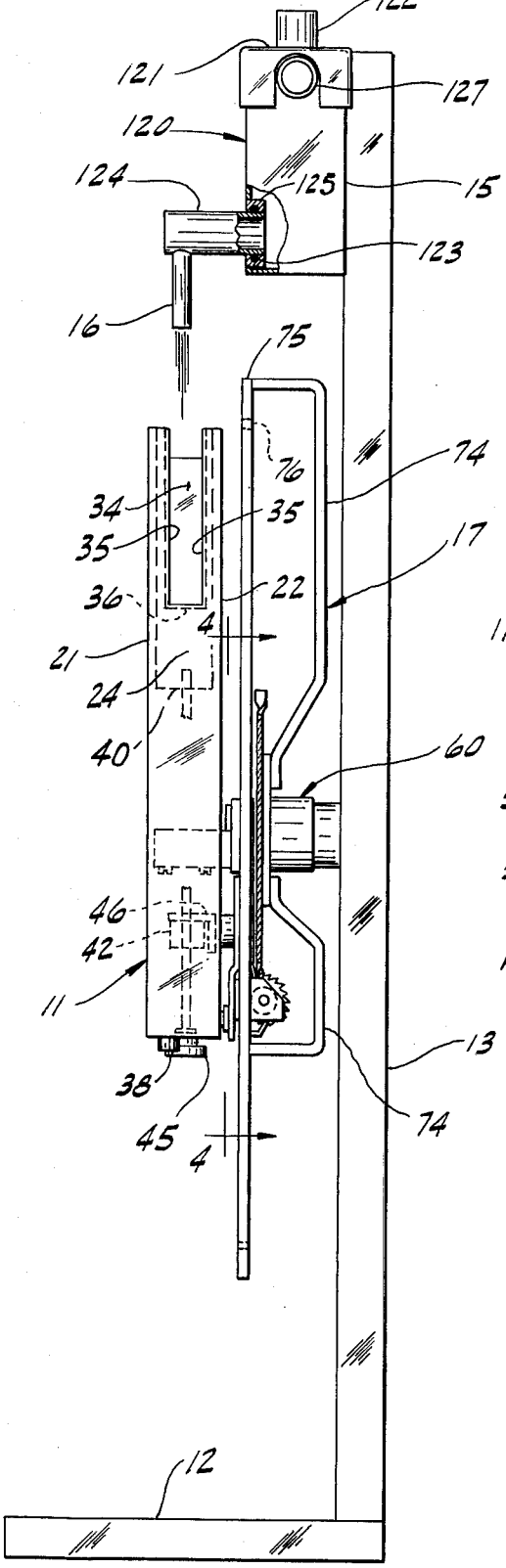
FIG. 2 is a side elevational view of the clock.

Referring now by reference characters to the drawings and first to FIGS. 1 and 2, it will be understood that the fluid clock is generally indicated by numeral 10 and comprises essentially a housing 11 pivotally mounted to a support means, consisting of a base 12 and a vertical support bracket 13, by means of a pivot assembly generally indicated by numeral 14. Fluid from a covered reservoir 15 is continuously dispensed from a spout 16 into the housing to supply a motive force alternately to opposite sides of the housing to induce oscillation therein. Oscillation of the housing 11 induces one-way rotary motion into an indicator ring assembly 17 having a pointer 18, which measures time against a relatively stationary clock face indicated by numeral 19. The translation of the oscillatory motion of the housing into rotary motion of the indicator assembly 17 is accomplished by a drive assembly 20, not shown in FIG. 1, as will be described. The components of the clock 10, including the drive assembly 20, will now be described with greater particularity.

The housing 11, which constitutes a pallet means, is substantially triangular in configuration in the embodiment shown, and includes front and rear panels 21 and 22 respectively, interconnected by side plates 23 and 24 and bottom plate 25. Partition members 26 and 27, symmetrically disposed to the left and right respectively of an axis defined by a line drawn between apex 28 and pivot center 29, are formed from a single channel-shaped member and extended between front and rear panels 21 and 22 to define fluid compartments 30 and 31 and an intermediate compartment 32. Side plates 23 and 24 include inlet openings 33 and 34 respectively, at their upper end leading to said compartments 30 and 31, each of said openings including inwardly formed side lips 35 and bottom lip 36. The bottom plate 25 is provided with discharge openings 37 and 38 formed by short, spout-like members communicating with associated fluid compartments 30 and 31 respectively.

The intermediate compartment 32 provides a housing for a balance weight 40, which is disposed above the housing pivot center 29. The center of gravity of the pallet means as a whole is disposed above the pivot center 29. In the preferred embodiment this is achieved by distributing the weight of the housing 11 so that the center of gravity of the housing 11, excluding balance weight 40, is disposed substantially at the pivot center 29. Accordingly, the disposition of the balance weight 40 above the pivot center 29 raises the combined center of gravity of the housing 11 and the weight 40 to the point above the pivot center. The balance weight 40 is substantially triangular in configuration and the center of gravity indicated by G in lengthwise adjustable along the apex axis. The adjustment means includes a pair of guide rods 41, fixedly attached to the weight 40 at their upper end and to a nut element 42 at their lower end. The bottom plate 25 is provided with a slot 43 which accommodates the grooved head 45 of an adjustment screw 44. An apertured bracket 46, fixedly attached to the housing rear panel 22, receives the reduced end 47 of the adjustment screw 44 in journal relation with the result that, as the adjustment screw 45 is rotated, the nut 42 moves lengthwise of said screw 44 providing vertical adjustment of the weight 40. A guide bracket 50 extends between and is connected to partition members 26 and 27, and includes apertures 51 receiving guide rods 41 in sliding relation to ensure that the movement of the weight 40 is along the apex axis.

Figure 3:
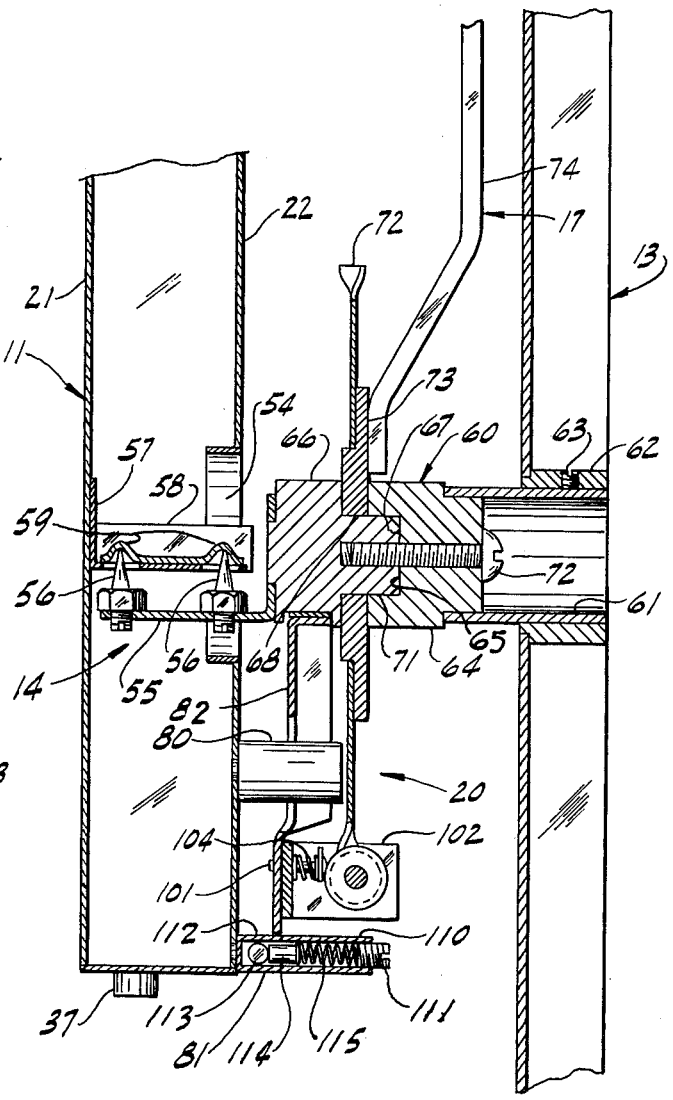
FIG. 3 is an enlarged, fragmentary cross sectional view taken on line 3—3 of FIG. 1.

The housing rear panel 22 includes a flanged aperture 54 which receives, as shown in FIG. 3, a mounting bracket 55, said bracket being operatively attached to the vertical support bracket 13 by means of a fixed shaft assembly indicated by numeral 60. The bracket 55 includes a pair of pivot pins 56, and a cooperating bracket 57, fixedly attached to the housing front panel 21. Bracket 55 is provided with an insert 58 having spaced dimples 59 receiving said pivot pins 56 in pivotal relation. It will be understood that the brackets 55 and 57 constitute the pivot assembly generally indicated by numeral 14. The housing 11 also includes an actuator pin 80, which actuates the drive assembly 20, as will be described, and a shock absorber 81, which defines the oscillating limits of said housing as will also be described with reference to the drive assembly.

The shaft assembly 60 is fixedly attached to the vertical support bracket 13 and to this end includes a sleeve portion 61 mounted to a fixed bushing 62 by means of a set screw 63. The shaft assembly also includes an apertured collar 64 which is provided with a socket 65, receiving the reduced end portion 67 of a shaft element 66, said reduced end portion 67 being of a length to provide a shaft bearing portion 68 receiving the hub 73 of a worm wheel 72 in rotational relation. It will be understood that the shaft element 66 is fixedly attached to the collar 64 by means of a pair of machine screws 69 threadedly connected to the shaft element 66.

The worm wheel hub 73 carries the indicator assembly 17 which rotates with the worm wheel 72. Said assembly 17 includes a plurality of radial spokes 74 having an outer ring 75 attached to the remote end and an inner ring 76 attached to said outer ring by means of spacer spokes 77. The worm wheel 72 forms parts of the drive means 20 and is operatively actuated by the actuator pin 80 as will now be described.

Figure 4:
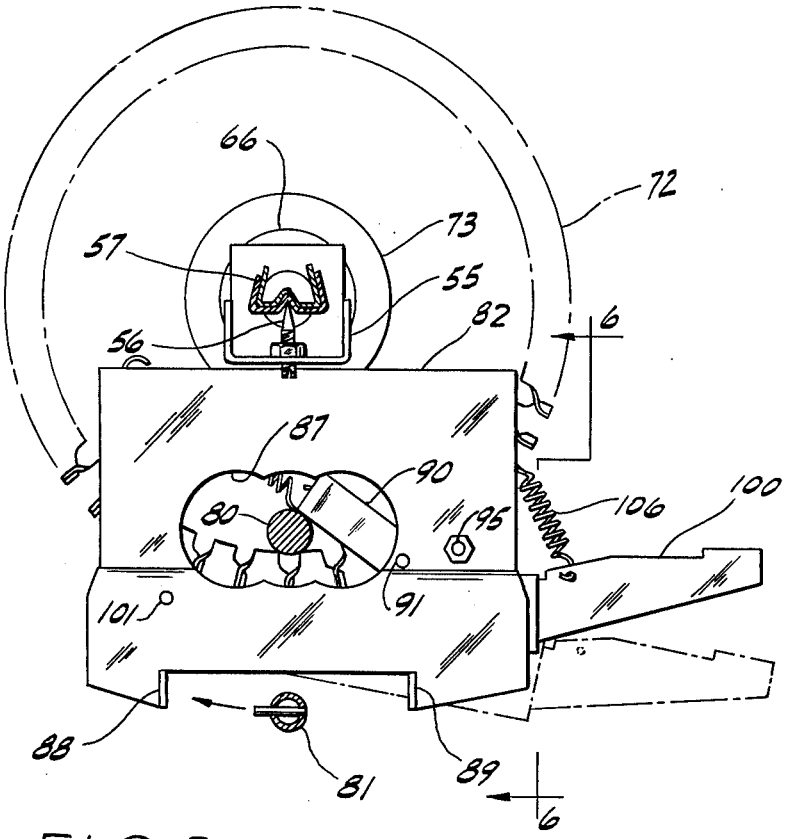
FIG. 4 is an enlarged front elevational view taken on line 4—4 of FIG. 3 illustrating the drive assembly and bracket.
Figure 5:
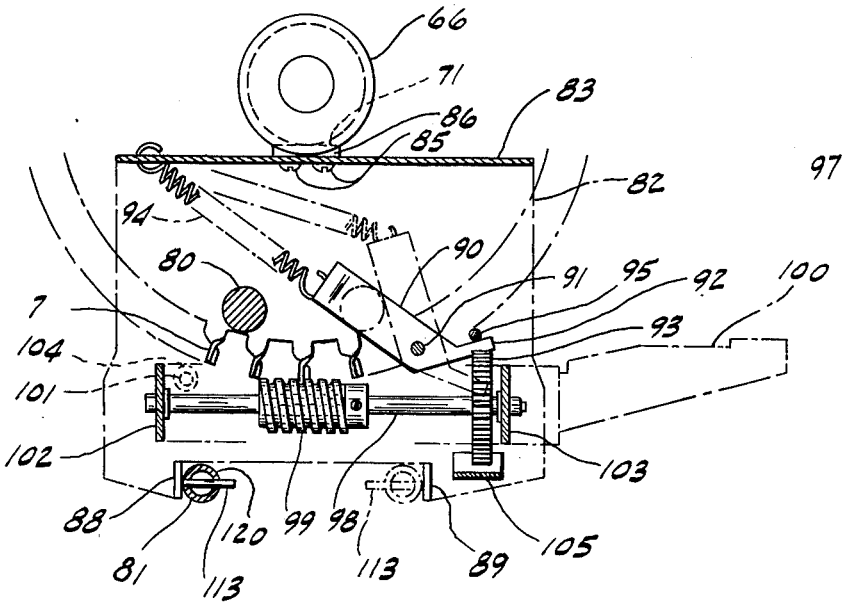
FIG. 5 is a similar view with the front portion of the bracket removed to reveal interior drive mechanism.

The drive assembly is mounted to the shaft assembly 60, and therefore to the vertical support bracket 13, by means of a main bracket 82. The bracket 82 includes an upper flange 83 which is attached to a flat 71, provided on the lower portion of the shaft element 66, by means of a pair of screws 85 as best shown in FIG. 5, a spacer 86 being provided between said flat 71 and said flange 83. As shown in FIG. 4 the bracket 82 includes an aperture 87 and a pair of outwardly projecting spaced lugs 88 and 89. It will be understood that the actuator pin 80 and the shock absorber 81 oscillate with the housing 11. Oscillation from one position to the other occurs when the weight of fluid supplied to the compartment on one side of the housing is sufficiently great to overcome the balance weight and the residual fluid in the compartment on the other side of the housing. The lugs 88 and 89 are engaged by the shock absorber 81 and define the oscillating limits of the housing 11, while the actuator pin 80 actuates the drive assembly 20, which will now be described.

Th drive assembly 20 includes a pawl 90, which is pivotally mounted by means of a pin 91 to the bracket 82, and is engaged by the actuating pin 80 during counterclockwise oscillation of the housing 11. The pawl 90 includes a finger portion 92, which is engageable with a ratchet wheel 93 when actuated by pin 80. Prior to engagement by the actuator pin 80 the pawl 90 is held in the position shown in FIG. 5 by means of a return spring 94 which extends between the remote end of said pawl 90 and the bracket upper flange 83. In this position the finger 92 is disengaged from the ratched wheel 93 and engages a stop 95, fixedly attached to the bracket 82. Upon engagement by the actuator pin 80 to the pawl moves into the position shown in phantom outline in FIG. 5 and the finger 92 moves downwardly into engagement with the ratchet wheel 93 to rotate said wheel angularly by an amount defined by one tooth of said wheel 93. When the housing 11, and therefore the actuator pin 80, reaches the oscillation limit as defined by the engagement of the shock absorber 81 with the bracket lug 89, and particular balance conditions are met, the actuator pin 80 moves in a clockwise direction out of engagement with the pawl 90 which returns to its original position.

Figure 6:
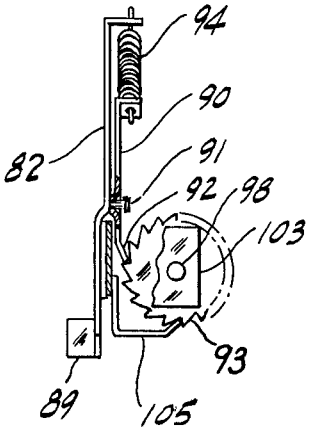
FIG. 6 is a side elevational view taken on line 6—6 of FIG. 4.
Figure 7:
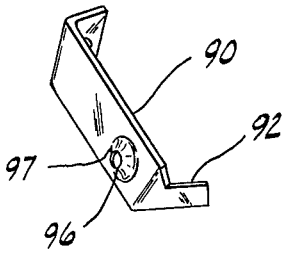
FIG. 7 is a perspective view of the pawl configuration.

In order to facilitate engagement between the pawl 90 and the teeth of the ratchet wheel 93 the finger 92 of said pawl is inclined inwardly, as best shown in FIGS. 6 and 7. Further, the pawl aperture 96 which receives the pin 91 in journal relation is provided with a dished margin portion which spaces the finger 92 from the bracket 82 and permits the pawl to move laterally. This mounting greatly facilitates engagement between the pawl 90 and the ratchet wheel 93 by allowing the finger to move sideways with the wheel 93. The ratchet wheel 93 is fixedly mounted to a shaft 98 and causes rotation of a worm gear 99, which is also fixedly mounted to said shaft 98, thereby driving the worm wheel 72. The worm gear 99 is disengageable from the worm wheel 72 by virtue of being mounted to a movable lever 100. The lever 100 is pivotally mounted to the bracket 82, which together constitute a drive mounting means, by means of a pin 101. The shaft 98 is journaled to said handle by virtue of a pair of outstanding lugs 102 and 103 which are apertured to receive said shaft 98. As best shown in FIG. 3 the pin 101, which pivotally mounts the lever 100 to the bracket 82, includes a spring element 104, which permits a degree of lateral movement of said lever 100. A pawl spring 105, best shown in FIG. 6, is fixedly attached to the lever 100 and permits movement of the ratchet wheel in one direction only. A return spring 106, best shown in FIG. 4, ensures that the lever 100 and therefore the worm gear 99, are biased upwardly. Engagement between said worm gear 99 and said worm wheel 72 is thereby maintained until such time as it is desired to adjust the angular disposition of the indicator ring assembly 17 attached to the wheel 72, which is achieved by depressing the lever 100.

The shock absorber 81 constitutes a stop means and provides a cushioned engagement of the housing 11 against bracket lugs 88 and 89, and is best understood by reference to FIG. 3. As shown in FIG. 3 the shock absorber 81 includes a sleeve 110 fixedly attached at one end to the housing rear panel 22 and internally threaded at the other end to receive a set screw 111. The sleeve 110 includes a pair of transversely bored apertures 112, which receive a pin 113 in sliding relation. The degree of ease with which the pin 113 slides within the apertures 112 is determined by the amount of pressure exerted upon said pin by a plunger element 114. The plunger element 114 is disposed within the sleeve 110 and is separated from the adjustment set screw 111 by means of a spring 115. It will be understood that the pressure of the plunger 114 is increased or decreased by rotation of the set screw 111, and that said pressure conditions the cushioning engagement of the ends of the pin 113 against associated limit lugs 88 and 89.

The reservoir 15 which supplies fluid to the housing 11 is best shown in FIG. 2 and includes a container portion 120 carried by the upper portion of the vertical bracket 13, to which it is attached. The container 120 is provided with a cover 121 having an inlet port 122 which, in the preferred embodiment, is supplied by fluid from a pumping station (not shown). The container body 120 includes a lower bushing 123 to which the spout 16 is attached. In the preferred embodiment the spout 16 includes a horizontal portion 124 grooved to receive an O-ring seal 125. As shown in FIG. 1 the reservoir 15 includes overflow pipes 127 which ensures that the outflow from the spout 16 is discharged continuously at a substantially constant rate.

It is thought that the structural features of this fluid clock have been fully apparent from the foregoing description of component parts, but for completeness of disclosure the operation of the clock will now be described. It will be assumed, initially, that the clock triangular housing 11 is in the position shown in FIG. 1 with the apex 28 to the right of the vertical centerline defining the fluid flow from the spout 16. In this position the center of gravity G of the balance weight 40, and therefore of the combined housing and weight, is above the pivot center 29 and is also disposed to the right. As shown in FIG. 5, the shock absorber 81 which is below the pivot center, is to the left of the centerline and is in engagement with bracket lug 88. Initially, when both of the compartments 30 and 31 of the housing 11 are empty, it remains in this position by virtue of the dispostion of the weight 40, which acts to bias the pivoted housing in a clockwise direction. While in this position, the fluid supply to the reservoir is actuated so that fluid from the spout 16 is supplied by way of slotted inlet opening 33 into the left chamber 30. The provision of marginal lips about openings 33 and 34 substantially precludes outwardly splashing of the fluid stream as it comes into contact with associated partitions, and further, the communicating nature of said openings 33 and 34 at the apex 28 likewise substantially precludes splash at this point during travel of the apex 28. The discharge port 37 of said chamber is of a size that permits an outflow of water at a lesser rate than the inflow and the differential weight gradually added to the chamber increases until a preponderance of weight is on the left side. This shift of weight results in counterclockwise movement of the housing 11 until the shock absorber 81 engages lug 88, at which time the triangular housing is in the position shown in broken outline in FIG. 1. During the travel of the shock absorber between lugs 88 and 89, the actuating pin 80 moves to the right and engages the pawl 90, causing it to pivot about pivot pin 91 and rotate the ratchet through an amount equal to one ratchet tooth. At this time fluid is still being discharged from compartment 30 by virtue of port 37 but, because of the new disposition of the housing, the spout 16 is now supplying fluid to the right compartment 31 through inlet opening 34. The weight 40 together with the fluid in the compartment 30 bias the triangular housing in a counterclockwise direction until the differential weight of fluid in chamber 31 is sufficiently great to overcome the bias of the weight 40 and the residual fluid in compartment 30, which will again return the housing 11 into the position shown in FIG. 1 with the result that shock absorber 81 again engages lug 88. During clockwise travel of the housing the actuating pin 80 moves out of engagement with the pawl 90 causing said pawl to resume the position shown in FIG. 5.

In the preferred embodiment the weight 40 and the size and disposition of the compartments 30 and 31, together with the supply and discharge differential, are such that the time interval for one cycle of movement is 10 seconds. The ratchet includes 24 teeth and therefore the worm makes one revolution in 240 seconds or 4 minutes. 5 revolutions of the worm are necessary to move the worm wheel one tooth which takes 20 minutes. The worm wheel is provided with 36 teeth, and therefore makes one complete revolution every 12 hours carrying the indicator ring assembly 17 and the pointer 18 with it. It will be understood that the position of the pointer 18 relative to the numerals on the fixed number plate 19, provides an indication of the passage of time.

The timing of the motion is effectuated by adjustment of the location of the weight 40, which is achieved by simply rotating the adjustment screw 44. It will be understood that, in effect, this adjustment screw 44 permits the weight to be moved closer or farther away from the vertical centerline, and by a change in leverage condition, increases or decreases the time interval at which balancing will occur.

The provision of the lever 100 permits the worm gear to be disengaged from the worm wheel so that the indicator ring assembly 17 can be moved to the correct location. Release of the lever 100 automatically moves the worm wheel into reengagement with the teeth by virtue of the return spring 106.

The nature of the pivotal mounting between the housing 11 and the support permits the housing to be removed at any time by simply lifting slightly and pulling forward.

I claim as my invention:

1. A fluid clock comprising:

a. support means.

b. pallet means including opposed fluid compartments each having an inlet opening and a discharge opening and a balance weight means, c. pivot means mounting said pallet means to said support means for oscillative movement about a pivot center disposed below the combined center of gravity of said pallet means including the balance weight means, d. a pair of limit means operatively engageable by said pallet means to determine the oscillative travel of said pallet means, e. fluid supply means disposed to supply fluid to one of said inlet openings when the pallet means engages one of said limit means and to supply fluid to the other of said inlet openings when the pallet means engages the other of said limit means, f. indicator means mounted in movable relation to the support means, and g. drive means actuated by the pallet means to move the indicator means in time indicating relation.

2. A fluid clock as defined in claim 1, in which:

h. the balance weight means includes adjustment means for selectively increasing or decreasing the spacing of the combined center of gravity above the pivot center.

3. A fluid clock as defined in claim 1, in which:

h. the pallet means includes a housing a partition means defining said opposed fluid compartments and an intermediate compartment disposed therebetween.

i. the balance weight means is mounted within said intermediate compartment.

4. A fluid clock as defined in claim 3, in which:

j. the partition means include upwardly convergent portions receiving the fluid stream, k. the inlet openings are disposed on opposite sides of the convergency axis and include inwardly turned lips substantially precluding outward splash of said fluid stream.

5. A fluid clock as defined in claim 1, in which:

h. the pallet means includes a stop means engageable with said limit means, said stop means including shock absorber means cushioning the engagement of said stop means with said limit means.

6. A fluid clock as defined in claim 5, in which:

i. the stop means includes a sleeve having a transversely bored hole, a pin slidably mounted in said hole, and pressure adjustable means within the sleeve exerting a force on the slidable pin to selectively adjust the sliding of the pin, said pin having opposite ends engageable with associated limit means to absorb the shock of impact of said pallet means.

7. A fluid clock as defined in claim 6, in which:

j. the support means includes a shaft means, k. the drive mounting means includes a bracket having a lever pivotally mounted thereto, l. the drive means includes a worm wheel mounted to the shaft and a worm gear rotated by said ratchet wheel and engageable with said worm wheel in driving relation said worm gear and said ratchet wheel being carried by said lever for selective disengagement of said worm gear from said worm wheel.

8. A fluid clock as defined in claim 1, in which:

h. the pallet means includes an actuating member, i. the support includes a shaft means having pivot means and a drive mounting means, j. the drive means includes a pawl and ratchet wheel, actuated by said actuating member, a worm and worm wheel driven by said ratchet wheel, said worm wheel being mounted in rotatable relation on said shaft means, and k. said indicator means includes a ring coaxially mounted in fixed relationship to said worm wheel for rotation therewith.

9. A fluid clock as defined in claim 8, in which:

l. said support means includes a vertical bracket member having the shaft means transversely attached thereto and the driving mounting means depends from said shaft means and includes spaced lugs providing the limit means, m. the pallet means includes a substantially triangular housing having partitions therewithin defining opposed fluid compartments and an intermediate compartment disposed therebetween, said balance weight being adjustably mounted therewithin for movement of the center of gravity thereof to increase or decrease the spacing of the center of gravity of said weight above the pivot center, n. said housing including an outstanding stop member, mounted substantially on the apex axis of said mounting ad engageable with said lugs of the drive mounting means, a pair of openings adjacent the apex providing the inlet openings, and interior pivot bearing means, supported by said shaft pivot means, and o. the fluid supply means includes a reservoir mounted to the vertical bracket member above the housing.

10. A fluid clock as defined in claim 1, in which:

h. the pallet means includes an actuating member oscillating about the pivot center, i. the support means includes drive mounting means, j. the drive means includes:

1. a pawl pivotally mounted to the drive mounting means for rotational movement about the pawl pivot axis and translational movement transversely of said pivot axis,
2. a ratchet wheel mounted to the drive mounting means for rotation about an axis substantially perpendicular to said pawl pivot axis,
3. said pawl being actuated by said actuating member into engagement with said ratchet to rotate said ratchet wheel, and said translational movement permitting said pawl to move with said ratchet wheel without binding, and
4. a return spring between said pawl and said drive mounting means tending to bias said pawl into its original position.

* * * * *